US006644502B2

(12) United States Patent
Pearce et al.

(10) Patent No.: US 6,644,502 B2
(45) Date of Patent: Nov. 11, 2003

(54) SHEET STACK HOLDING APPARATUS FOR A PRINTER OR COPIER

(75) Inventors: Christopher Pearce, Herts (GB); Jeffery W. Ryan, Herts (GB); Brian Martin, Barkers Lane (GB); Andy K. Balm, Herts (GB)

(73) Assignee: Xerox Corporation, Stamford, CT (US)

( * ) Notice: Subject to any disclaimer, the term of this patent is extended or adjusted under 35 U.S.C. 154(b) by 118 days.

(21) Appl. No.: 10/022,898

(22) Filed: Dec. 20, 2001

(65) Prior Publication Data

US 2003/0116907 A1 Jun. 26, 2003

(51) Int. Cl.[7] ..... B65H 01/08
(52) U.S. Cl. ..... 221/127
(58) Field of Search ..... 271/145, 151, 271/37, 38, 171, 144, 223, 123, 126, 127, 233, 255; 414/791.5; B65H 1/00, 1/22, 1/18, 3/52, 1/08, 9/10, 9/04

(56) References Cited

U.S. PATENT DOCUMENTS 4,010,944 A * 3/1977 Young ..... 271/99
4,795,297 A * 1/1989 Tokuno et al. ..... 414/795.4
5,286,018 A * 2/1994 Rasmussen et al. ..... 271/147
5,377,969 A 1/1995 Steinhilber ..... 271/21
5,709,381 A * 1/1998 Hourtash et al. ..... 271/147
5,803,631 A * 9/1998 Bingham et al. ..... 400/624

FOREIGN PATENT DOCUMENTS

JP 2000-34024 * 2/2000 ..... B65H/1/04

* cited by examiner

*Primary Examiner*—Donald P. Walsh
*Assistant Examiner*—Kenneth W Bowes
(74) *Attorney, Agent, or Firm*—R. Hutter

(57) ABSTRACT

Certain designs of paper feeding devices used in copiers and printers require that an edge of a stack of sheets be in close contact with a slanted surface. An apparatus engages an opposite edge of the stack to urge the stack against the slanted surface, so that the stack assumes a parallelogram shape. The apparatus includes a plate which is movable from a vertical, upright position to a slanted position. Means are provided to cause the plate to move to the slanted position in response to the closing of a paper tray of a printer or copier.

8 Claims, 6 Drawing Sheets

SHEET STACK HOLDING APPARATUS FOR A PRINTER OR COPIER

FIELD OF THE INVENTION

The present invention relates to office equipment such as printers and copiers, and in particular relates to an apparatus for holding a stack of sheets, as would be used in a paper supply for such equipment.

BACKGROUND OF THE INVENTION AND DESCRIPTION OF THE PRIOR ART

U.S. Pat. No. 5,377,969 describes a feeding apparatus for drawing sheets from a stack of paper, as would be used in a printer or copier. A stack of sheets is held so that one side of the stack abuts a slanted surface, so that, viewed elevationally, the stack assumes a generally parallelogram shape. The slanted surface is exploited by rollers which engage the top sheet of the stack, to ensure that exactly one sheet is drawn at a time when the printer or copier is in use.

The present invention relates to a device for holding a stack of sheets in a parallelogram shape.

SUMMARY OF THE INVENTION

According to one aspect of the present invention, there is provided an apparatus useful in retaining a stack of sheets, comprising a plate for engaging an edge of the stack of sheets, and a mechanism for selectably positioning the plate in an upright position and a slanted position.

According to another aspect of the present invention there is provided a printing apparatus, comprising a paper tray for retaining a stack of sheets, a plate for engaging an edge of the stack of sheets and a mechanism for selectably positioning the plate in an upright position and a slanted position.

BRIEF DESCRIPTION OF THE DRAWINGS

In the above Figures, like numerals indicate functionally equivalent elements in various embodiments.

DETAILED DESCRIPTION OF THE INVENTION

Figure 1:
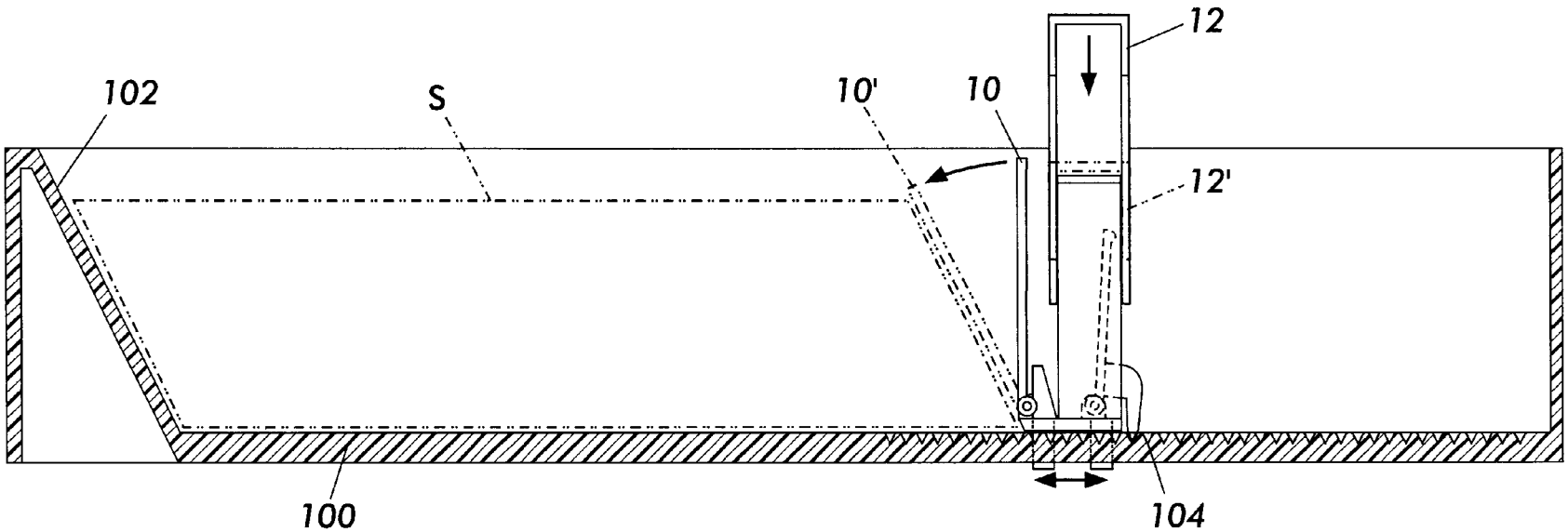
FIG. 1 is an elevational sectional view of a paper supply drawer, as used in a copier or printer, using the present invention.

FIG. 1 is a sectional elevational view of a paper supply drawer, or tray, as would be found, for instance, in a printer, copier, or other office equipment, showing some essential features of the present invention. With most relevance to the present invention, the drawer 100 defines a slanted surface 102, which is a generally flat surface disposed approximately 30 to 60 degrees from the vertical. As described above in the '969 patent, a certain type of paper feeding apparatus exploits such a slanted surface, and it is desirable that a paper stack, such as indicated in FIG. 1 as S, be disposed with one of its edges abutting such a slanted surface.

According to the illustrated embodiment, one edge of a paper stack S is caused to abut slanted surface 102 by the presence and action of a plate 10 in contact with an opposite side of the stack. When a stack S is initially placed in the drawer, with the typical vertical sides (such as when removed from a package), one side of the stack is in general contact with plate 10, which is in a substantially vertical "upright position" as shown. After the stack S is loaded, the plate 10 is moved to a substantially slanted position as shown in phantom and indicated as 10'. When plate 10' is in the second position, the opposite side of stack S is pushed against slanted surface 102, and the stack S generally assumes a parallelogram shape, as shown.

Also shown in FIG. 1 is a lever 12, which interacts with plate 10, and is shown in a position which is consistent with plate 10 being in its upright position. Shown in phantom and indicated as 12' is the lever in a position consistent with plate 10' being in its second position. The various possible mechanical means by which lever 12 interacts with plate 10 will be discussed below.

Figure 2:
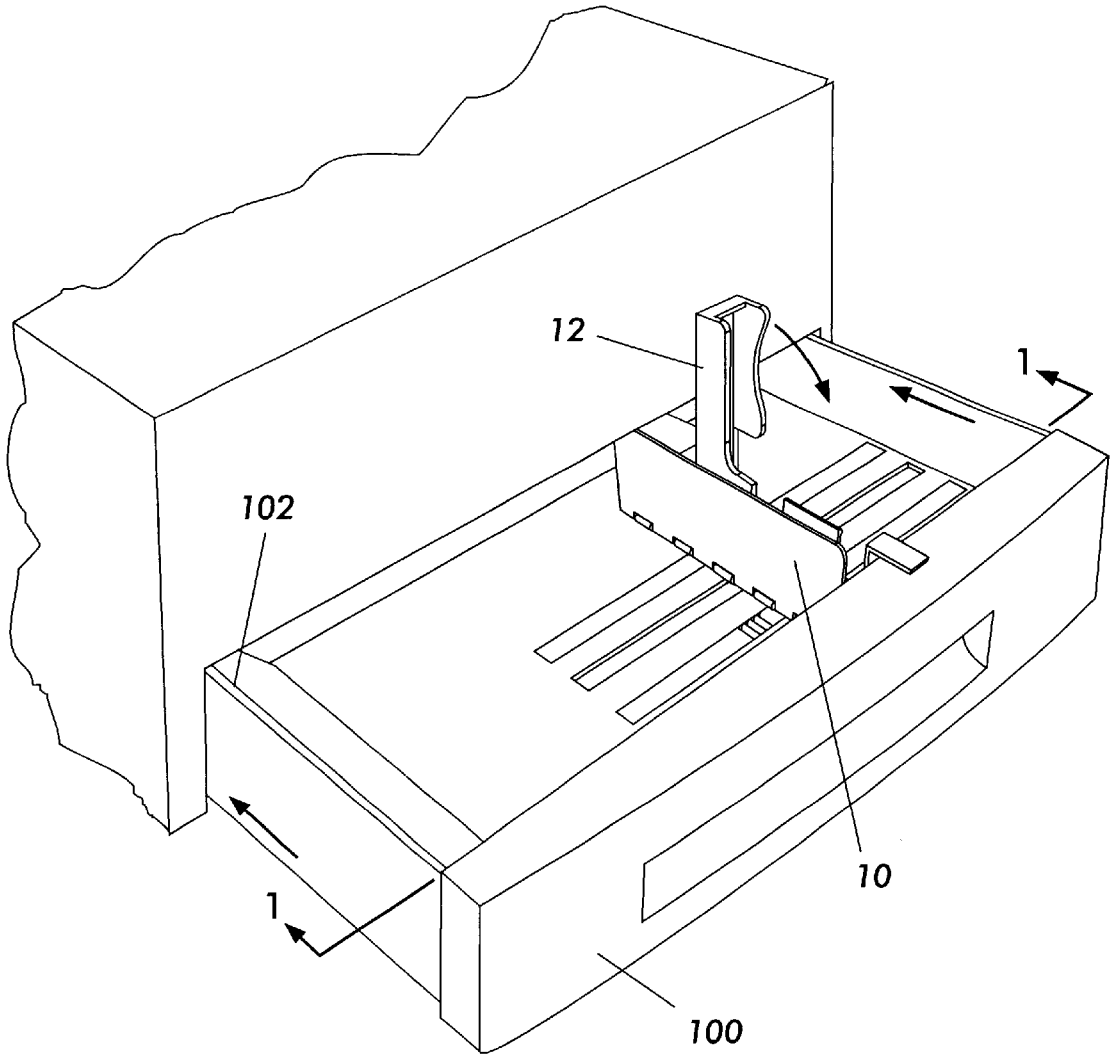
FIG. 2 is a perspective view of a portion of the exterior of a printer, showing an embodiment of the present invention.

FIG. 2 is a perspective view of a portion of some office equipment, such as a printer or copier, in which a paper supply drawer or tray such as 100 is used. As is familiar, such a drawer 100 can be slid in and out from the body of the machine so that paper can be re-supplied to the machine. According to this embodiment of the invention, lever 12 is shaped and located so that, when drawer 100 is pushed back into the machine, such as after loading a stack of paper therein, lever 12 contacts a "contact surface" of the machine and is thus pushed downward as the drawer 100 is closed. As the lever 12 is pushed down, through a mechanism of a type which will be described in detail below, plate 10 is caused to move from its upright position to its slanted position, as described above. In turn, a stack of paper placed in the drawer 100 assumes the desired parallelogram shape and is pressed against the slanted surface 102. In brief, pushing the drawer 100 in causes the stack S to assume the parallelogram shape. According to this aspect of the invention, the contact surface of a machine for this purpose can be an outer surface of the machine, as shown in FIG. 2, or can be on a member internal to the machine. Alternately, lever 12 can be in effect attached to a member within the body of the machine.

In order to provide the desired interaction between lever 12 and plate 10, any number of types of mechanisms can be used. Below, certain mechanisms will be basically described, but it will be apparent that many variations can be made to the described mechanisms within the spirit and language of the claims.

Figure 3:
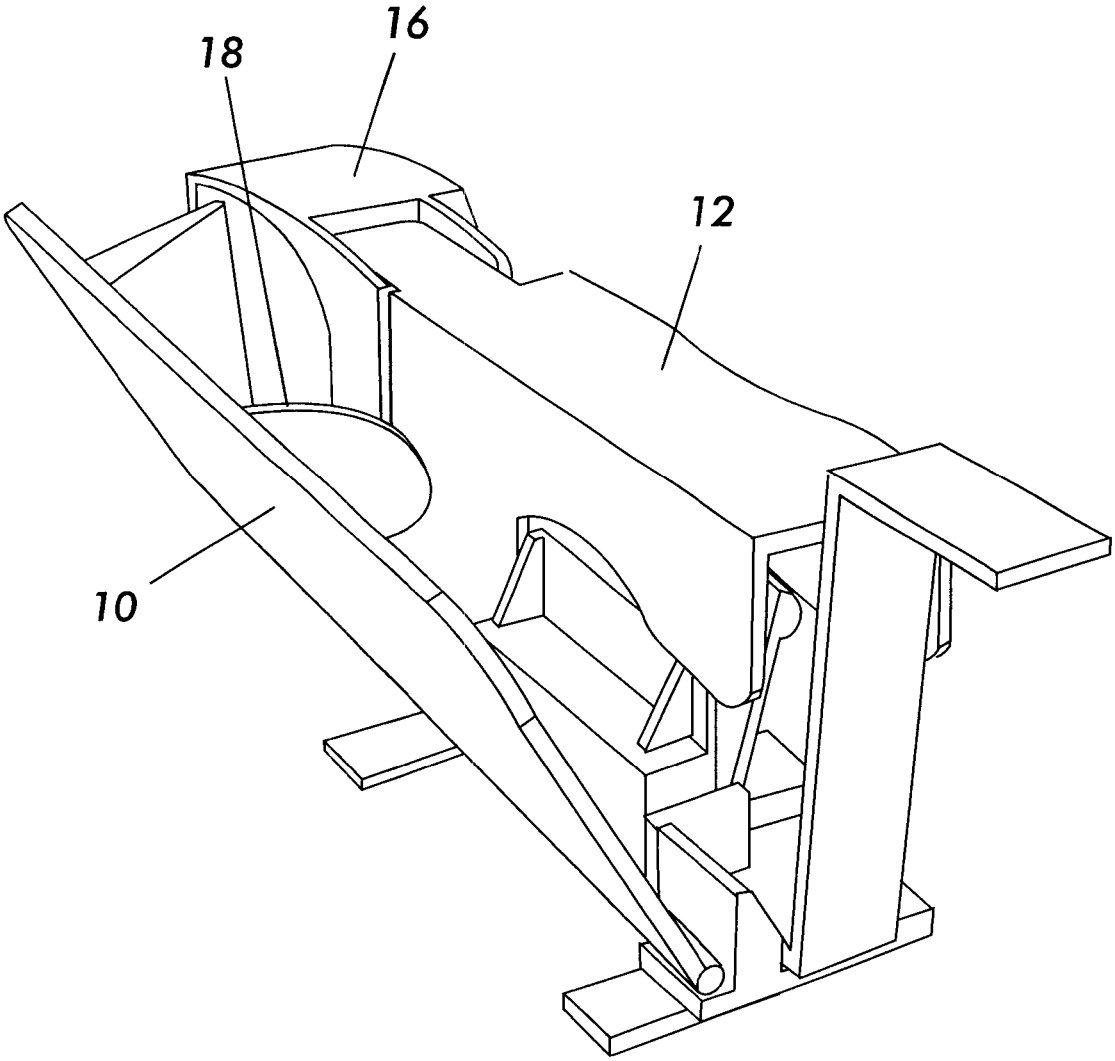
FIG. 3 is a perspective view of one embodiment of the present invention.

FIG. 3 is a perspective view of one embodiment of the present invention. In this embodiment, plate 10 is movable between and upright position and a slanted position, as shown. Plate 10 assumes its slanted position when lever 12, which is pivotably mounted relative to a main portion 16 of a mechanism which supports plate 10 in a particular position, is in a down position (as opposed to the up position, such as shown in FIG. 2). The mechanism includes at least one camming surface, such as 18, which in effect transfers the motion of the downward positioning of lever 12 to move the plate 10 to its slanted position. When the lever 12 is pulled up again, the plate 10 returns to an upright position, either through the action of another camming surface, or of springs associated with the mechanism (not shown).

Figure 4:
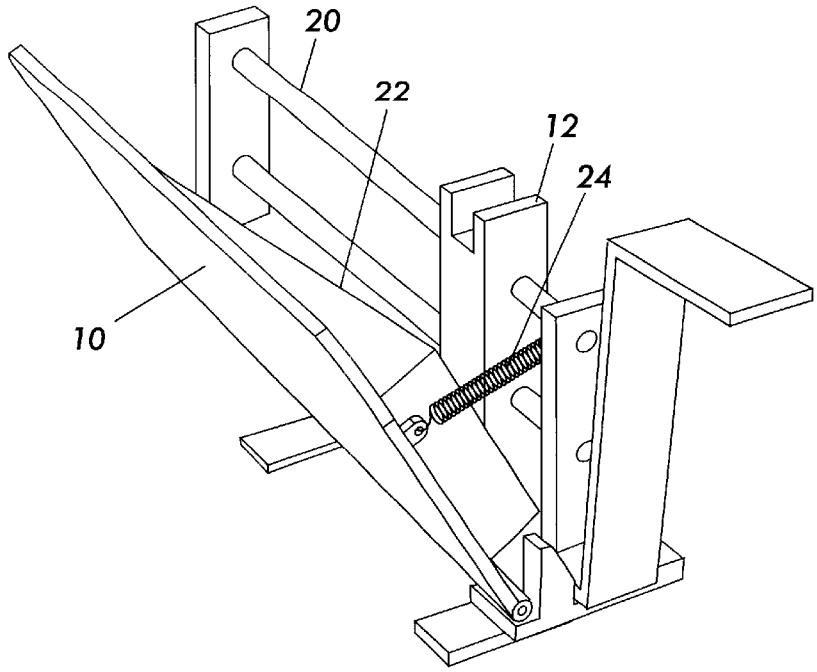
FIG. 4 is a perspective view of another embodiment of the present invention.

FIG. 4 is a perspective view of an alternate embodiment of the present invention. In this case, the plate 10 is once again caused to change position by the action of a lever 12, but the lever 12 slides relative to the basic mechanism instead of pivoting. The member forming lever 12 slides along a bar 20 while a surface thereof engages a camming surface 22 associated with plate 10. In this particular embodiment, when lever 12 is slid to the right in the Figure, the plate 10 is moved to its slanted position; when the lever 12 is slid to the left, plate 10 returns to an upright position, aided by spring 24. Although a very simple mechanism is illustrated, many practical variations on the design can be contemplated to allow the sliding action of lever 12 and resulting positioning of plate 10.

In the FIG. 4 embodiment, the lever 12 can be attached to or otherwise contact other surfaces (not shown) of the rest of a machine, to achieve the principle of "automatic" positioning of plate 10 to its slanted position when a paper tray or drawer is closed. The lever 12 can contact the outside of a machine, as largely shown in FIG. 2 above, or contact or be attached to a member within the body of the machine. In the FIG. 4 view, if the drawer and the attached mechanism including lever 12 is pushed to the left, the lever 12 will contact a surface of the machine, be pushed to the right, and therefore place plate 10 in its slanted position.

Figure 5:
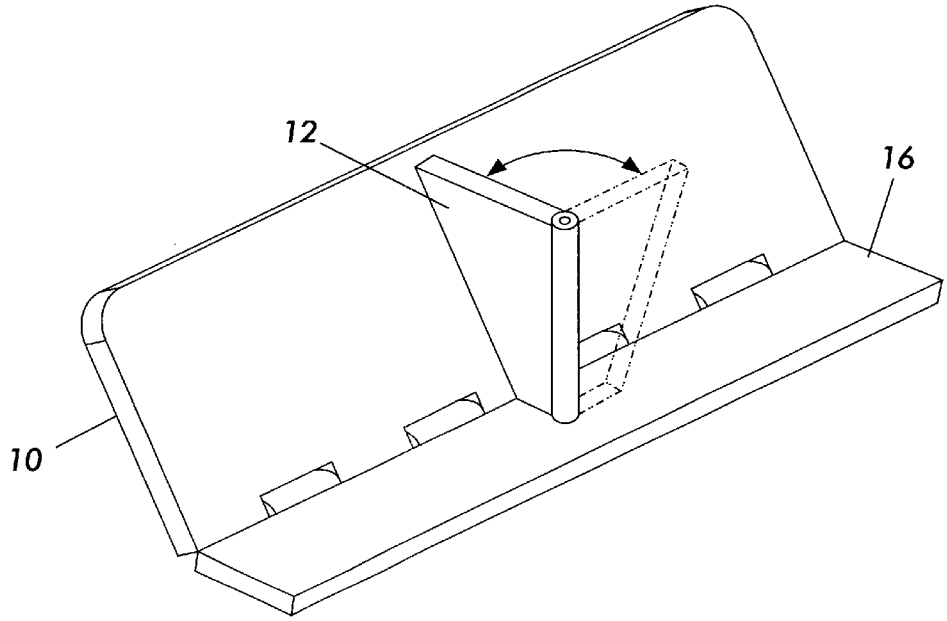
FIG. 5 is a perspective view of another embodiment of the present invention.

FIG. 5 is a perspective view of another possible embodiment of the present invention. Here, the plate 10 is more or less directly moved, such as by a user's hand, into a slanted position as needed, and a lever 12, pivotably mounted on a surface (such as a main portion 16 as shown, or even a bottom surface of a paper tray or drawer), functions mainly as a "stop" to hold plate 10 in its slanted position. In this case, the "mechanism" for positioning plate 10 basically comprises the hinge on which plate 10 is mounted.

As is well known in the art of office equipment, a paper tray or drawer is typically provided with adjustable parts so that the tray can accommodate paper stock of various sizes. Returning to FIG. 1 above, it is desirable that the position of plate 10 in terms of distance to slanted surface 102 be adjustable so that a stack S of a range of sizes can be placed properly in the tray. To this end, there is provided means for adjusting the position of plate 10, and such means can include a track 14, which can be defined by a set of teeth or other structure in the body of tray 100. The plate 10 and its associated mechanism moves along track 14 as needed to conform to a stack S of a given size.

Figure 6:
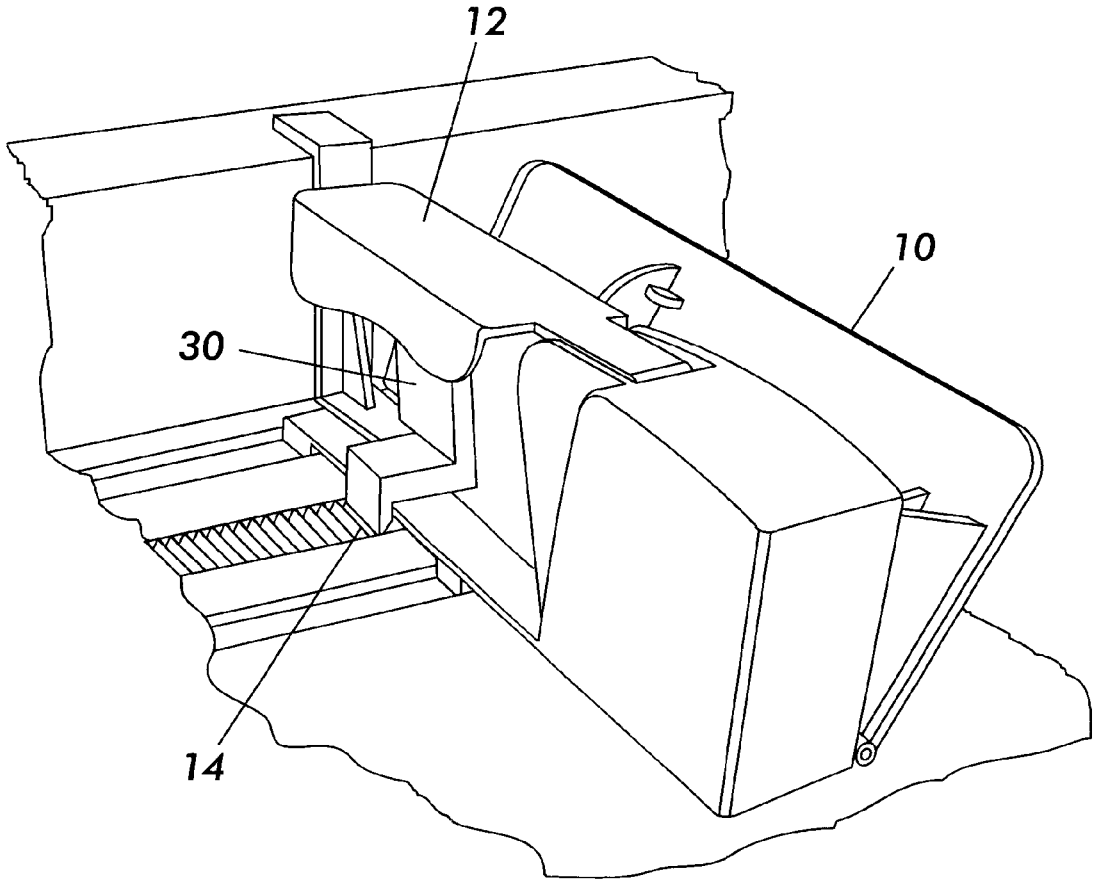
FIG. 6 is a perspective view showing an additional aspect of the present invention.

FIG. 6 is a perspective view of another aspect of the present invention, what can generally be called a slidable mount for adjusting a position of the plate 10, particularly relative to slanted surface 102 such as shown in FIG. 1. A catch 30, which can be of any design, engages the teeth of track 14 to retain the plate 10 in a selected position relative to slanted surface 102. Any basic design of such a slidable mount, generally familiar in the art, can be provided, with or without the illustrated teeth in track 14. Another aspect of the invention is disposing the catch 30 or equivalent element underneath lever 12 when lever 12 is in a position consistent with plate 10 being in a slanted second position. The position of lever 12 thus makes catch 30 largely inaccessible, so that the position of plate 10 cannot be changed when the plate is in its slanted position.

Although the illustrations show plate 10 as a substantially solid plate with a flat surface, it will be appreciated that the plate 10 can be of any practical configuration, such as including openings, fingers, ridges, etc. as required to enhance performance.

Figure 7:
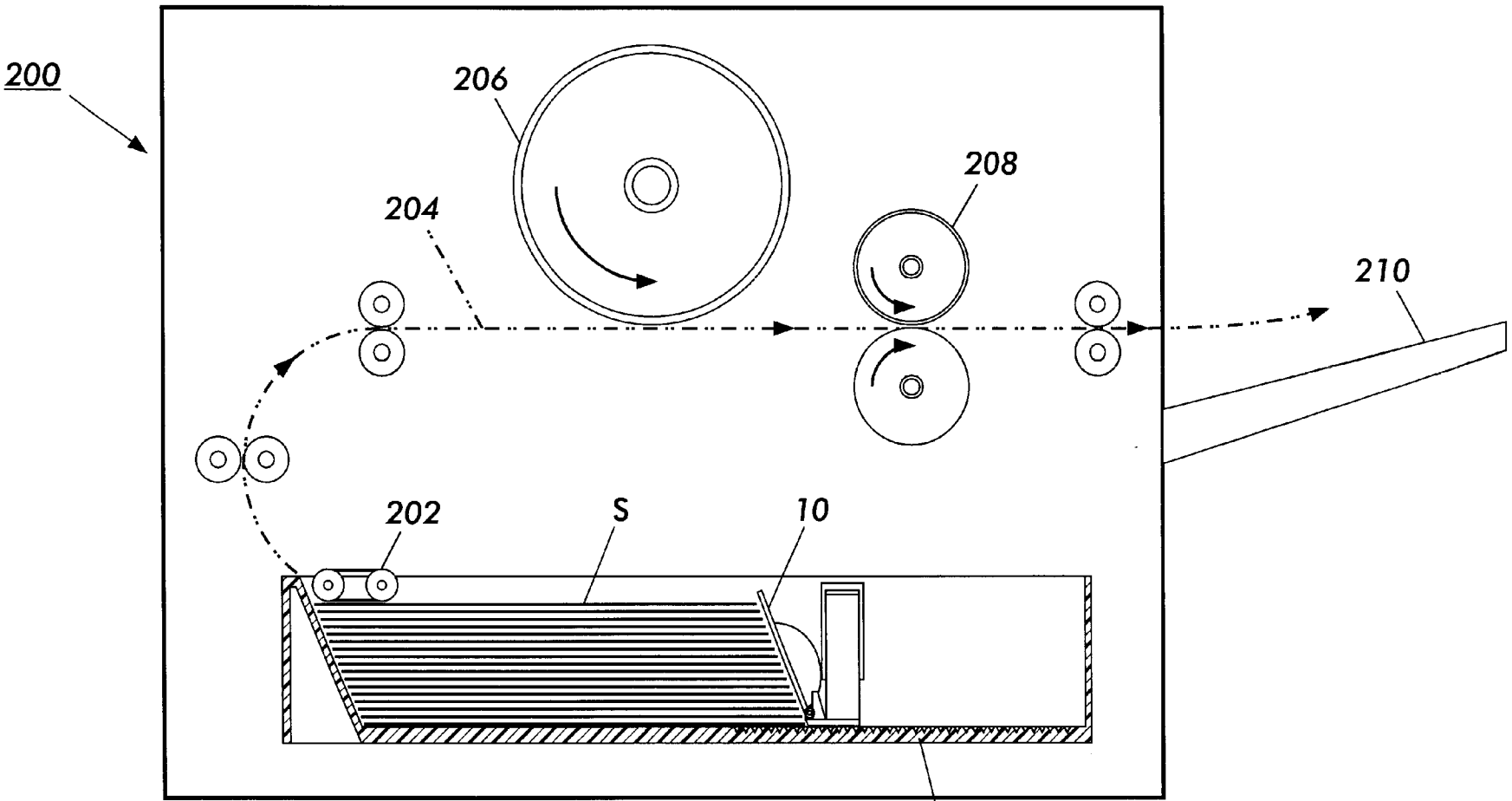
FIG. 7 is a simplified elevational view of a xerographic printer including the present invention.

FIG. 7 is a simplified elevational view of an office machine, in this case a xerographic or electrostatographic printer 200 (which may also function as part of a copier or facsimile machine) embodying the present invention. Sheets from a tray 100 are stacked in a parallelogram-shaped stack S by the action of plate 10. Sheets are individually drawn by feed head 202 from stack S in a manner such as shown in the '969 patent, and sent through paper path 204. Each sheet receives marking material forming an image from charge receptor 206, and the marking material is fused in fuser 208 and deposited in tray 210 or other finishing device.

What is claimed is:

1. A printing apparatus, comprising:

a paper tray for retaining a stack of sheets;

a plate for engaging an edge of the stack of sheets;

a mechanism for selectably positioning the plate in an upright position and a slanted position, the mechanism including a lever positionable in a first position and a second position, the first position being consistent with the plate being in the upright position and the second position consistent with the plate being in the slanted position;

the paper tray being slidable relative to a body of the apparatus, the body of the apparatus defining a contact surface; and means for positioning the lever in the second position when the paper tray is slid into the body of the apparatus, wherein the lever contacts the contact surface when the paper tray is slid into the body of the apparatus.

2. The apparatus of claim 1, wherein the lever is pivotably mounted relative to the mechanism.

3. The apparatus of claim 1, wherein the lever is slidably mounted relative to the mechanism.

4. A printing apparatus, comprising:

a paper tray for retaining a stack of sheets;

a plate for engaging an edge of the stack of sheets;

a mechanism for selectably positioning the plate in an upright position and a slanted position, the mechanism including a lever positionable in a first position and a second position the first position being consistent with the plate being in the upright position and the second position consistent with the plate being in the slanted position; and a slidable mount for the plate within the tray, wherein the slidable mount is at least partially covered by the lever when the lever is in the second position.

5. The apparatus of claim 1, further comprising a charge receptor for placing images on a sheet drawn from the stack.

6. The apparatus of claim 4, wherein the lever is pivotably mounted relative to the mechanism.

7. The apparatus of claim 4, wherein the lever is slidably mounted relative to the mechanism.

8. The apparatus of claim 4, further comprising a charge receptor placing images on a sheet drawn from the stack.

* * * * *